US007174862B2

(12) United States Patent
Hertlein et al.

(10) Patent No.: US 7,174,862 B2
(45) Date of Patent: Feb. 13, 2007

(54) COMBUSTION-ENGINED SETTING TOOL

(75) Inventors: Peter Hertlein, Gams (CH); Iwan Wolf, Chur (CH); Mario Zahner, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/232,183

(22) Filed: Sep. 20, 2005

(65) Prior Publication Data

US 2006/0065219 A1 Mar. 30, 2006

(30) Foreign Application Priority Data

Sep. 29, 2004 (DE) ..... 10 2004 047 279

(51) Int. Cl.
*B25C 1/04* (2006.01)

(52) U.S. Cl. ..... 123/46 H; 123/46 R

(58) Field of Classification Search ..... 123/46 R, 123/46 H

See application file for complete search history.

(56) References Cited

U.S. PATENT DOCUMENTS

| | | | | |
|---|---|---|---|---|
| 6,260,519 | B1 * | 7/2001 | Phillips | 123/46 R |
| 6,491,002 | B1 * | 12/2002 | Adams | 123/46 R |
| 6,520,127 | B1 * | 2/2003 | Thieleke et al. | 123/46 R |
| 2005/0098123 | A1 * | 5/2005 | Miyata et al. | 123/46 SC |
| 2006/0042573 | A1 * | 3/2006 | Nishikawa et al. | 123/46 H |
| 2006/0102111 | A1 * | 5/2006 | Ohmori et al. | 123/46 H |
| 2006/0185630 | A1 * | 8/2006 | Fujisawa et al. | 123/46 H |

* cited by examiner

*Primary Examiner*—Stephen K. Cronin
*Assistant Examiner*—Jason Benton
(74) *Attorney, Agent, or Firm*—Abelman, Frayne & Schwab

(57) ABSTRACT

A combustion-engined setting tool (10) for driving in fastening elements such as bolts, nails, and the like in a constructional components includes an inlet/outlet valve arrangement (20) that connects the combustion chamber (13) of the setting tool (10), which is filled with an air-fuel mixture, with at least two tool openings (33, 34), has an inlet (21) connectable with a first tool opening (33) and an outlet (22) connectable with the second tool opening (34).

9 Claims, 4 Drawing Sheets

COMBUSTION-ENGINED SETTING TOOL

BACKGROUND OF THE INVENTION

1. Field of the Invention

The present invention relates to a combustion-engined setting tool for driving fastening elements such as nails, bolts, and the like in a constructional component and that includes a combustion chamber which is being filled with an air-fuel mixture, and an inlet/outlet valve arrangement that connects the combustion chamber with tool openings which communicate with the environment.

2. Description of the Prior Art

In setting tools described above, fuel, such as, e.g., fuel gas, is combusted with an environmental air in the combustion chamber. Before each setting process, fresh air should be fed into the combustion chamber, and after each setting process, flue gases, which are produced during a combustion process, should be expelled from the combustion chamber.

In a conventional combustion-engined setting tool, such as Hilti GX 100 of the assignee herein, a setting piston is displaced in a piston guide that is adjoined, in the setting or drive-in direction, by a bolt guide. At the end of the piston guide remote from the bolt guide, there is provided a combustion chamber. The combustion chamber has a rear wall coaxially displaceable in the combustion chamber. When the setting tool is pressed against a constructional component, the rear wall is displaced away from the end of the combustion chamber adjacent to the piston guide up to the end of the combustion chamber remote from the piston guide, loading the return springs. The combustion chamber assumes an expanded position. Simultaneously with the expansion of the combustion chamber, fresh air is fed thereinto through the inlet/outlet valve. After completion of the setting process and lifting of the setting tool off the constructional component, the rear wall is displaced to its initial position by the biasing force of the return springs. As the combustion chamber collapses, the flue gases are expelled through the inlet/outlet valve. The advantage of the setting tool, which is described above, consists in that no accumulator or battery is needed, as the flushing of the combustion chamber is effected mechanically.

In this setting tool, the flue gas can be expelled from the setting tool in the same volume of the environment from which the fresh air is aspirated. This can result in contamination of the aspirated fresh air with the flue gas which can reduce the energy efficiency of the combustion process.

Accordingly, an object of the present invention is to provide a setting tool in which the drawback of the conventional setting tool is eliminated.

SUMMARY OF THE INVENTION

This and other objects of the present invention, which will become apparent hereinafter, are achieved by providing an inlet/outlet valve arrangement having separated from each other, inlet connectable with the first tool opening and outlet connectable with the second tool opening that is spatially spaced from the first tool opening.

With an inlet/outlet valve arrangement according to the present invention, the fresh air for a combustion process can be aspirated from an environmental volume different from an environmental volume the flue gas is discharged into.

It is advantageous when the combustion chamber is connected with the first tool opening by the inlet of the inlet/outlet valve arrangement in a first operational phase or position of the inlet/outlet valve arrangement, is closed in a second operational phase or position of the inlet/outlet valve arrangement, and is connected with the second tool opening by the outlet of the inlet/outlet valve arrangement in the third operational phase or position of the inlet/outlet valve arrangement. Thus, the combustion chamber is connectable with different environmental volumes during aspiration of the fresh air and during discharge of the flue gas, respectively. By separation of the operational phases or positions of the inlet/outlet valve arrangement according to the present invention, a clear separation of the incoming air from the outgoing flue gas is achieved. Advantageously, the inlet/outlet valve arrangement is formed as a shuttle valve.

Advantageously, the inlet/outlet valve arrangement includes a closure member for closing the inlet, a closure member for closing the outlet, and a closure member for closing a combustion chamber opening of the inlet/outlet valve arrangement, with the closing member for the combustion chamber opening being actuated by a press-on element of the setting tool. The foregoing measures insure a technically simple association of the operational phases of the inlet/outlet valve arrangement with the setting process.

The provision of a first channel for connecting the inlet of the inlet/outlet valve arrangement with the first tool opening and a second channel for connecting the outlet with the second tool opening permits to further improve separation of the incoming air from the flue gases that are removed from the setting tool.

Further, the provision of the second channel for connecting the outlet with the second tool opening prevents accumulation of the flue gases in the setting tool housing and an uncontrolled discharge of the flue gas.

Advantageously, the first and/or second channel has an elastic section. The elastic section insures a medium tight connection of the inlet and/or outlet of the inlet/outlet valve arrangement with the tool openings even for the displaceably arranged combustion chamber casing and/or the rear wall of the combustion chamber. The elastic section or sections can be formed, e.g., as bellows.

It is advantageous when the second channel extends, at least regionwise, past the outlet of the setting tool. This permits to use so-called "jet effect" (as in injection pumps) which is produced by suction of the outlet and which improves the discharge of the flue gases in the second channel.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE INVENTION

Figure 1:
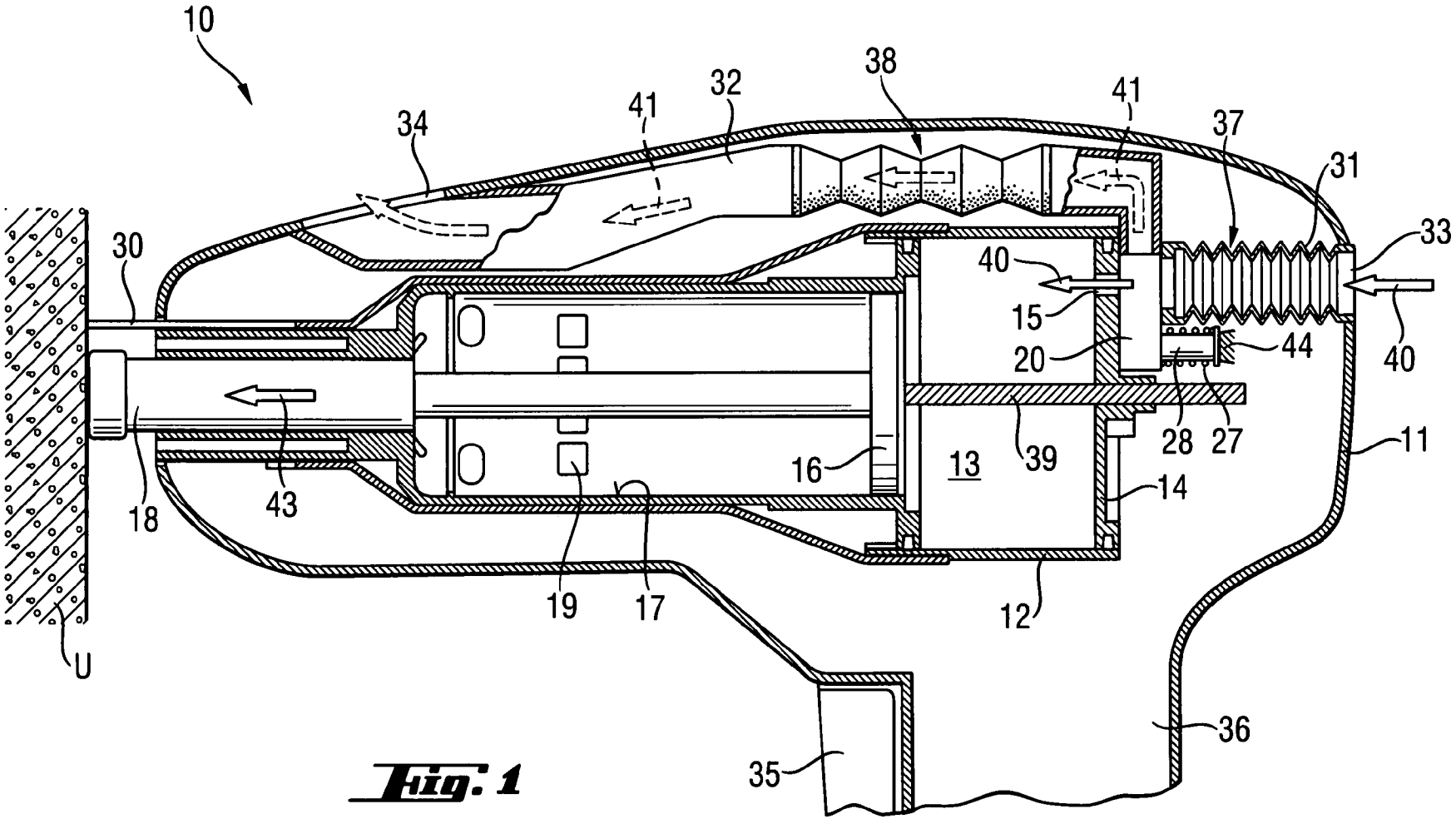
FIG. 1 a side cross-sectional view of a setting tool according to the present invention in a press-on position.

A setting tool 10 according to the present invention, which is shown in FIGS. 1–4, operates on a liquid or gaseous fluid which is stored in a fuel reservoir (not shown).

The setting tool 10 has a housing 11 in which there is arranged a setting mechanism with which a fastening element such as a nail, a bolt or the like can be driven in a constructional component U (FIGS. 2–5) when the setting tool 10 is pressed against the constructional component U and is actuated by an actuation switch 36 arranged on a handle 35 of the setting tool 10. The actuation switch 36 also actuates an ignition device (not shown), that ignites an air-fuel mixture contained in a combustion chamber 13.

The setting mechanism includes, among others, a combustion chamber casing 12 in which the combustion chamber 13 is expandable, a piston guide 17 in which a setting piston 16 is displaceably arranged, and a bolt guide 18 in which a fastening element can be displaced by setting direction end of the forward movable setting piston 16 and, thereby, be driven in a constructional component. The combustion chamber casing 12, the piston guide 17, and the bolt guide 18 are preferably arranged coaxially with each other. At the end of the piston guide 17 adjacent to the bolt guide 18, there are provided outlet openings 19 through which a portion of flue gases can flow out of the piston guide 17 when the setting piston 16 is located in its end position remote from the combustion chamber 13.

In the embodiment shown in the drawings, the combustion chamber casing 12 is displaceably arranged with respect to the piston guide 17 and is elastically biased by a spring (not shown in the drawings), in a direction toward the bolt guide 18 or in a direction of a collapsed position of the combustion chamber 13. The setting tool 10 further includes a press-on element 30 that engages with one of its end the combustion chamber casing 12, while its opposite end projects from the housing 11 and extends, in an inoperative position of the setting tool 10 (not shown in the drawings) beyond the bolt guide 18. The combustion chamber casing 12 has, at its end remote from the piston guide 17, a combustion chamber rear wall 14 with which, the combustion chamber casing 12 is securely connected. The rear wall 14 of the combustion chamber 13 can, meanwhile, be displaced medium tight in the combustion chamber casing 12. The rear wall 14 is supported for a medium tight displacement on at least one guide member 39 during a medium tight displacement of the combustion chamber casing 12 over the rear end of the piston guide 17.

Feeding of air into the combustion chamber 13 and removal of flue gases from the combustion chamber 13 take place through openings 15 formed in the combustion chamber rear wall 14. An inlet/outlet valve arrangement, which is generally designated with a reference numeral 20 and is arranged outside of the combustion chamber 13 in the region of the rear wall 14, controls flow of air into the combustion chamber 13 and flow of flue gases therefrom. An inlet 21 of the inlet/outlet valve arrangement 20 is connected by a channel 31 or a first conduit with a first tool opening 33 formed in the section of the housing 11 of the setting tool 10 remote from the bolt guide 18. The channel 31 has an elastic section 37 that is formed as a bellows. At the inlet 21, there is provided a closure member 24 which is formed as a flap valve that functions as an inlet check valve. The closing member 24 provides for flow of air in the inlet/outlet valve arrangement 20 but prevents flow of the flue gas out of the inlet/outlet valve arrangement 20 and into the channel 31.

An outlet 22 of the inlet/outlet valve arrangement 20 is connected by an outlet channel 29 and a second channel 32 or the second conduit, which is connected with the outlet channel 29, with a second tool opening 34 of the setting tool 10 which is formed in the section of the housing 11 located between the bolt guide 18 and the first tool opening 33. The second channel 32 has an elastic section 38 formed as a bellows. At the outlet 22, there is provided a closure member 25 which s formed as a flap valve that functions as an outlet check valve that provides for flow of the flue gas from the inlet/outlet valve arrangement 20 in the channel 32 but prevents flow of air into the inlet/outlet valve arrangement 20. The channel 32 extends past an outlet (not shown) that starts from outlet openings 19, whereby a "jet effect", which is produced by suction from the outlet is used in order to improve the flow of the flue gases in the channel 32. The tool openings 33 and 34 communicate, because of their spacing from each other, with different volumes of the surrounding air. Therefore, the suction of the fresh air and the ejection of the flue gas cannot be based on the same volume of the surrounding air.

Figure 2:
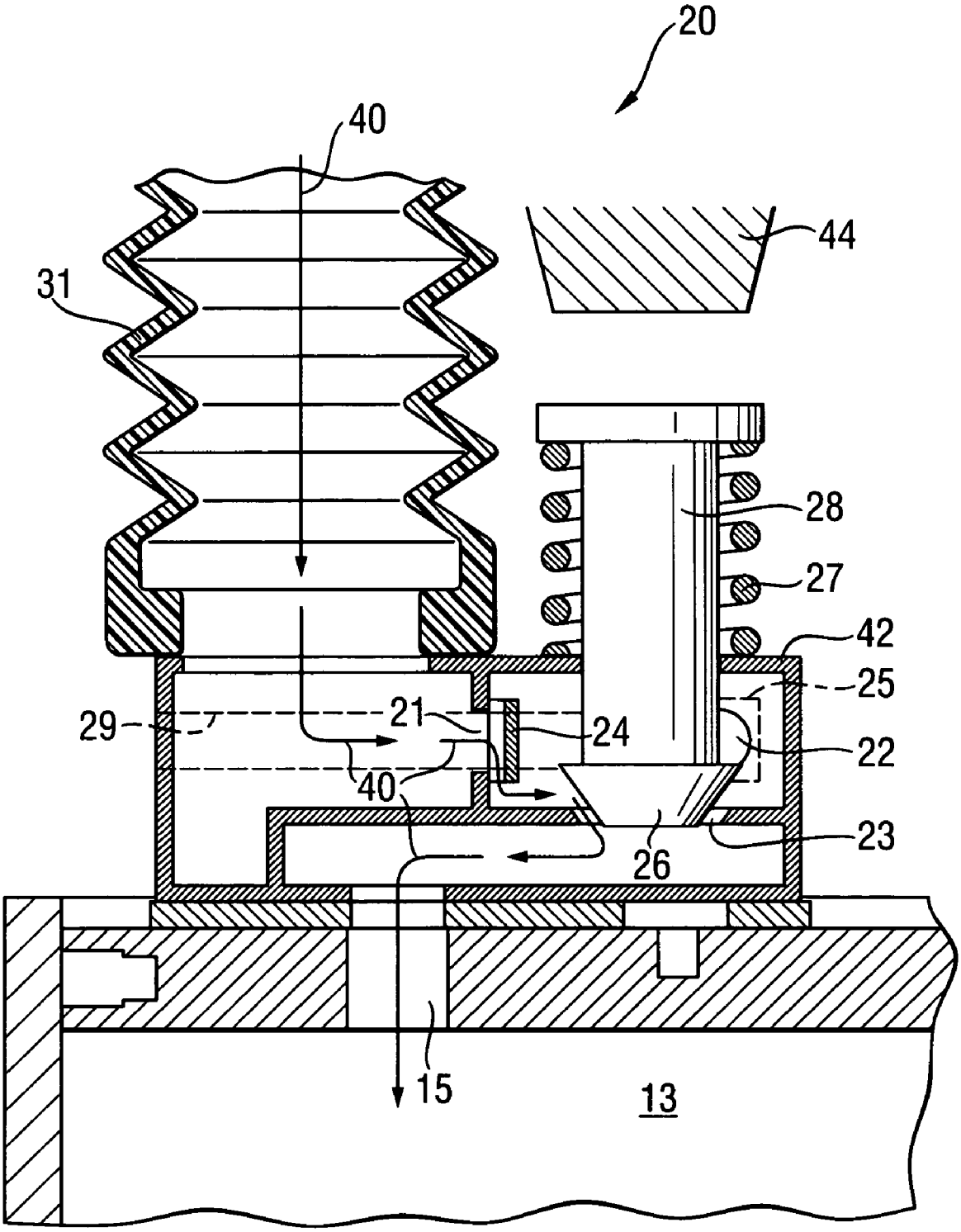
FIG. 2 a cross-sectional view of a detail of the setting tool shown in FIG. 1, at an increase, in comparison with FIG. 1, scale, during a process of pressing the setting tool against a constructional component.
Figure 3:
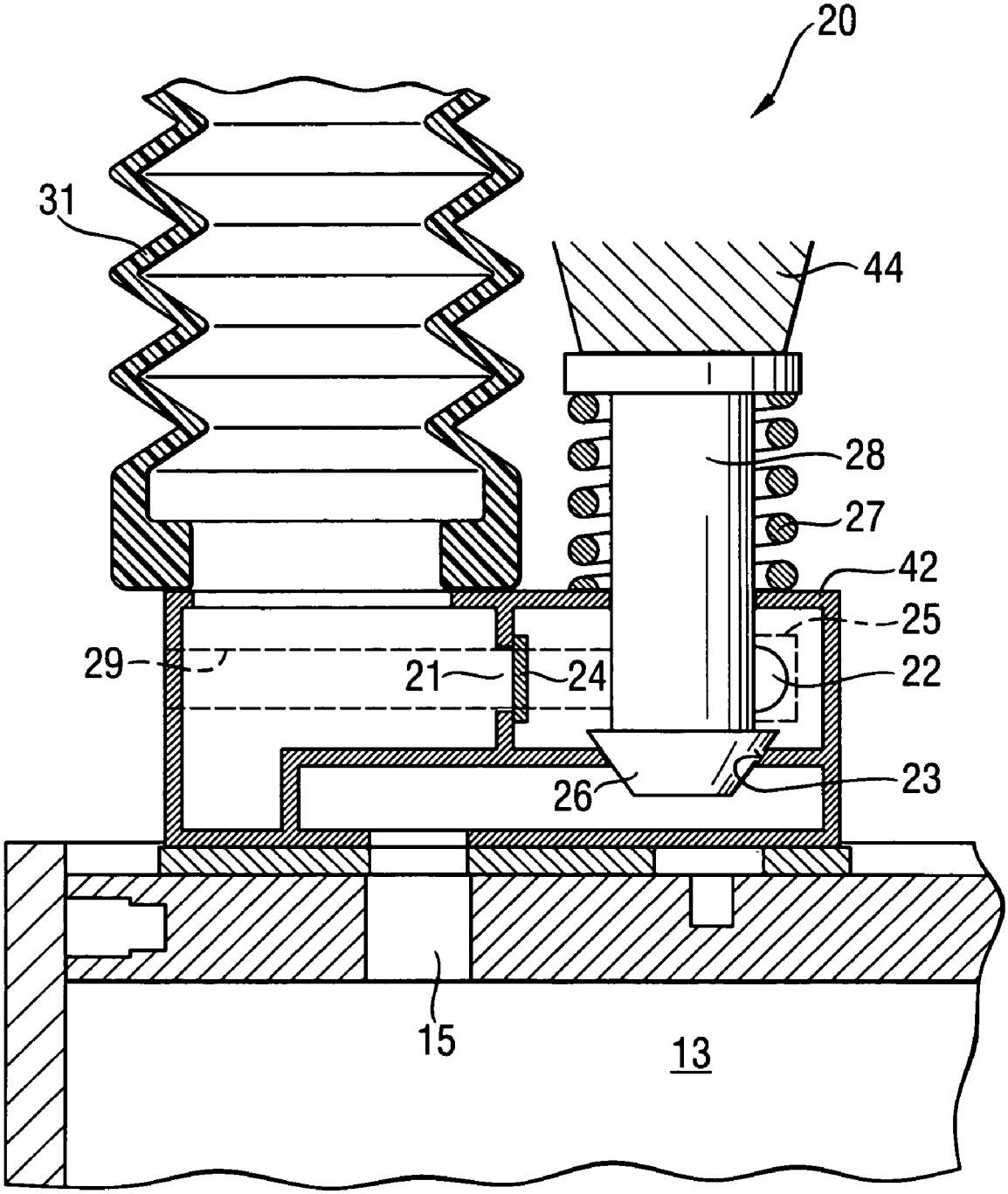
FIG. 3 a cross-sectional view of the detail shown in FIG. 2 during a setting process.
Figure 4:
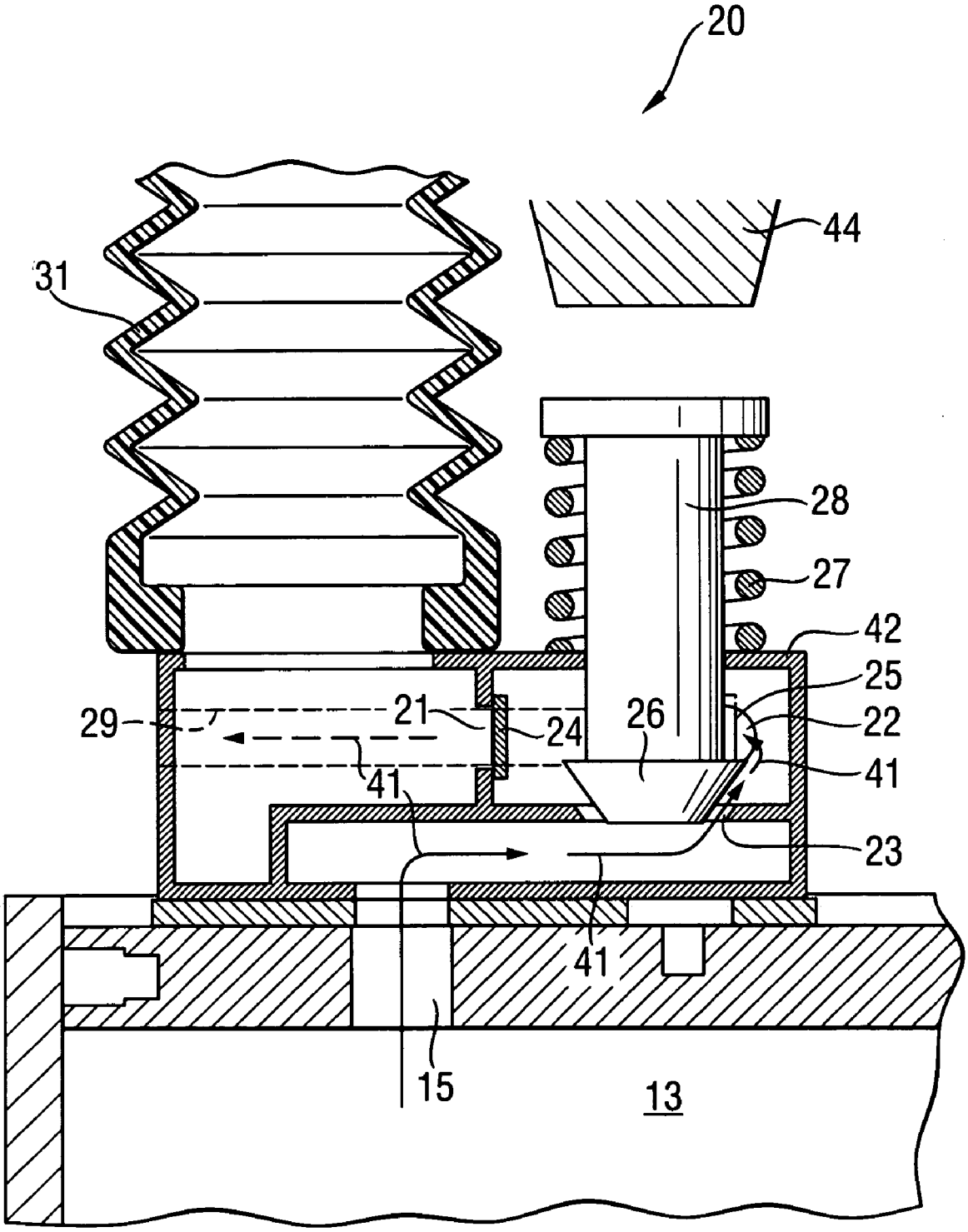
FIG. 4 a cross-sectional view of the detail shown in FIG. 2 during lifting of the setting tool off the constructional component.

The inlet/outlet valve arrangement 20 also includes a closure member 26 which is actuated during a press-on process and with which a combustion chamber opening 23 of the inlet/outlet valve arrangement 20, which communicates with the combustion chamber 13 or its opening 15, is closed (see FIG. 3). The combustion chamber opening 23 of the inlet/outlet valve arrangement 20 and the closure member 26 form together a pass valve. The closure member 26 is arranged at the end of a plunger 28 that is supported by a return member 27, which is formed as a spring, on a wall 42 of the housing of the inlet/outlet valve arrangement 20. The return member 27 elastically biases the closing member 26 to a position in which the combustion chamber opening 23 is at least partially open (see FIGS. 2 and 4). During a press-on displacement of the setting tool 10 in the direction of arrow 43 (FIG. 1), the combustion chamber casing 12 and the rear wall 14 move way from the piston guide 17, and the combustion chamber 13 expands (FIG. 1).

During expansion of the combustion chamber 13, on one hand, air flows into the combustion chamber 13 through the tool opening 33 and the opening 15 in the direction of arrow 40, and on the other hand, fuel flows through a fuel conduit (not shown) out of the fuel reservoir and into the combustion chamber 13.

As shown in FIG. 2, during the press-on process, the inlet/outlet valve arrangement 20 provides a connection between the first channel 31 and the combustion chamber 13, so that fresh air can be aspirated in the direction of arrow 40 by the expanding combustion chamber 13. The closing member 24, which is formed as a flap valve, releases the inlet 21, and the closing member 26 releases the combustion chamber opening 23. The closing member 25 closes the outlet 22 of the inlet/outlet valve arrangement 20.

When the setting tool 10 is completely pressed against the constructional component, as shown in FIG. 1, the inlet/outlet valve arrangement 20 assumes a position shown in FIG. 3. In this position, the closing member 26, which is retained in its closed position against the biasing force of the return member 27 by a stop 44, closes the combustion chamber opening 23 of the inlet/outlet valve arrangement 20. The closing members 24 and 25 close the inlet 21 and the outlet 22. In this position of the inlet/outlet valve arrangement 20, the combustion chamber 13 is completely sealed and is ready for a setting process.

After the setting process has been completed, and the setting tool 10 is lifted of the constructional component U, the closing member 26 is lifted from the combustion chamber opening 23 under the action of the return member 27, opening the opening 23 of the inlet/outlet valve arrangement 20. Because of the overpressure in the collapsible combustion chamber 13, the flue gas flows under pressure in the inlet/outlet valve arrangement 20, displacing the closing member 25, which is formed as valve flap, opening the outlet 22. The flue gas can only flow from the combustion chamber 13 in the direction of arrow 41 through the outlet 22 of the inlet/outlet arrangement 20, the outlet channel 29, the second channel 32, and toward the second tool opening 34.

With a new setting process, the above-described cycle is repeated.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool for driving fastening elements in a constructional component, comprising:

a combustion chamber (13) that is being filled with an air-fuel mixture and is connectable with environment by spaced from each other, first (33) and second (34) tool openings; and an inlet/outlet valve arrangement (20) for connecting the combustion chamber (13) with the first (33) and second (34) tool openings and having separated from each other inlet (21) connectable with the first tool opening (33) and outlet (22) connectable with the second tool opening (34).

2. A setting tool according to claim 1, wherein the combustion chamber (13) is connected with the first tool opening (33) by the inlet (21) of the inlet/outlet valve arrangement (20) in a first operational phase of the inlet/outlet valve arrangement (20), is closed in a second operational phase of the inlet/outlet valve arrangement (20), and is connected with the second tool opening (34) by the outlet (22) of the inlet/outlet valve arrangement (20) in the third operational phase of the inlet/outlet valve arrangement (20).

3. A setting tool according to claim 1, wherein the inlet/outlet valve arrangement (20) is formed as a shuttle valve.

4. A setting tool according to claim 1, wherein the inlet/outlet valve arrangement (20) comprises a first closure member (24) for closing the inlet (21), a second closure member (25) for closing the outlet (22), and a third closure member (26) for closing a combustion chamber opening (23) of the inlet/outlet valve arrangement (20), the third closing member (26) being actuated by a press-on element (30) of the setting tool (10).

5. A setting tool according to claim 1, wherein the inlet/outlet valve arrangement (20) has a first channel (31) for connecting the inlet (21) thereof with the first tool opening (33).

6. A setting tool according to claim 1, wherein the inlet/outlet valve arrangement (20) has a second cannel (32) for connecting the outlet (22) thereof with the second tool opening (34).

7. A setting tool according to claim 6, wherein at least one of the first and second channels (31, 32) have at least one elastic section (37, 38).

8. A setting tool according to claim 7, wherein the elastic section (37, 38) is formed as bellows.

9. A setting tool according to claim 6, wherein the second channel (32) extends, at least partially, past the setting tool outlet.

* * * * *